US007472520B2

(12) United States Patent
Everett et al.

(10) Patent No.: US 7,472,520 B2
(45) Date of Patent: Jan. 6, 2009

(54) STRUCTURAL BUILDING BLOCK SYSTEM AND METHOD COMPRISING SAME

(76) Inventors: Steve Eugene Everett, 1619 Wheeless La., Austin, TX (US) 78723; Jay Dean Everett, 1619 Wheeless La., Austin, TX (US) 78723

( * ) Notice: Subject to any disclaimer, the term of this patent is extended or adjusted under 35 U.S.C. 154(b) by 373 days.

(21) Appl. No.: 11/257,939

(22) Filed: Oct. 25, 2005

(65) Prior Publication Data

US 2006/0207206 A1 Sep. 21, 2006

Related U.S. Application Data

(60) Provisional application No. 60/662,250, filed on Mar. 17, 2005.

(51) Int. Cl.
*E04C 2/52* (2006.01)
*E04B 2/00* (2006.01)
*E04B 5/04* (2006.01)

(52) U.S. Cl. ..... 52/220.2; 52/592.1; 52/607

(58) Field of Classification Search ..... 52/604, 52/592.1, 592.6, 503, 220.2, 220.3, 606, 52/607, 504, 505, 284, 302.4, 424, 425, 561; 446/124, 125

See application file for complete search history.

(56) References Cited

U.S. PATENT DOCUMENTS 112,925 A * 3/1871 Johnson ..... 52/505
292,887 A * 2/1884 Austin ..... 52/591.2
509,180 A * 11/1893 Parks ..... 52/561
721,751 A * 3/1903 Scott ..... 52/604
797,205 A * 8/1905 Inman ..... 52/505
1,009,441 A * 11/1911 Sawyer ..... 52/424
1,226,214 A * 5/1917 Hopkins ..... 52/426
1,329,893 A * 2/1920 Flynn ..... 52/562
1,385,299 A * 7/1921 Bilque ..... 52/98
1,404,823 A * 1/1922 Williams ..... 52/415
1,429,252 A * 9/1922 Piette ..... 432/247
1,529,183 A * 3/1925 Howren ..... 110/336
1,798,331 A * 3/1931 Liptak ..... 52/562
1,846,849 A * 2/1932 Covell ..... 52/425
1,984,393 A * 12/1934 Brown ..... 52/284
2,023,023 A * 12/1935 Kaufman ..... 52/98
2,141,035 A * 12/1938 Daniels ..... 202/223
2,174,875 A * 10/1939 Freeman ..... 52/286
2,371,201 A * 3/1945 Wells ..... 52/505
RE22,913 E * 9/1947 Wells ..... 52/505
2,493,435 A * 1/1950 Arehambault ..... 446/122

(Continued)

*Primary Examiner*—Richard E Chilcot, Jr.
*Assistant Examiner*—Brent W Herring
(74) *Attorney, Agent, or Firm*—David O. Simmons

(57) ABSTRACT

A building block arrangement configured for constructing residential, industrial and commercial structures comprises a first layer of building blocks and a second layer of building blocks. The first layer of building blocks includes two spaced apart rows of building blocks whereby a space is provided between adjacent side faces of the building blocks of the first layer. The second layer of building blocks includes two spaced apart rows of building blocks whereby a space is provided between adjacent side faces of the building blocks of the second layer. The space includes communicative horizontal and vertical portions such that that the space at least partially isolates an interior wall portion from an exterior wall portion. The second layer of building blocks is positioned on top of the first layer of building blocks. The second layer of building blocks spans across at least a portion of the space in the first layer of building blocks.

19 Claims, 7 Drawing Sheets

U.S. PATENT DOCUMENTS 3,220,141 A * 11/1965 Goss, III ..... 446/124
4,031,678 A * 6/1977 Schuring ..... 52/570
4,107,894 A * 8/1978 Mullins ..... 52/592.6
4,597,236 A * 7/1986 Braxton ..... 52/564
4,744,780 A * 5/1988 Volpe ..... 446/128
4,990,116 A * 2/1991 Chen ..... 446/124
5,122,015 A * 6/1992 Shen ..... 405/284
5,365,714 A * 11/1994 Potvin ..... 52/590.2
5,402,609 A * 4/1995 Kelley, Jr. ..... 52/98
5,676,540 A * 10/1997 Williams et al. ..... 432/247
5,685,120 A * 11/1997 Sihra ..... 52/604
5,729,943 A * 3/1998 Cambiuzzi ..... 52/438
5,816,749 A * 10/1998 Bailey, II ..... 405/286
5,881,511 A * 3/1999 Keller, Jr. ..... 52/220.2
5,960,604 A * 10/1999 Blanton ..... 52/604
6,088,987 A * 7/2000 Simmons et al. ..... 52/592.6
6,134,853 A * 10/2000 Haener ..... 52/405.2
6,223,480 B1 * 5/2001 Khoo ..... 52/79.9
6,477,814 B1 * 11/2002 Kadosh ..... 52/439
6,645,033 B1 * 11/2003 Thomsen ..... 446/120
6,651,401 B2 * 11/2003 Price et al. ..... 52/604
6,799,405 B2 10/2004 Gilbert
2004/0040245 A1 3/2004 Sinclair et al.

* cited by examiner

STRUCTURAL BUILDING BLOCK SYSTEM AND METHOD COMPRISING SAME

CROSS REFERENCE TO RELATED APPLICATIONS

This patent application claims priority to co-pending U.S. Provisional Patent Application having Ser. No. 60/662,250 filed Mar. 17, 2005 entitled "Interlocking, Space Forming, Soil Masonry, Block And System", having a common applicant herewith and being incorporated herein in its entirety by reference.

FIELD OF THE DISCLOSURE

The disclosures made herein relate generally to building blocks configured for use in constructing residential, industrial and commercial structures and, more particularly, to building block systems configured for building such structures.

BACKGROUND

The practice of building structures such as, for example, homes from structural building blocks is well known. Examples of such structural building blocks include stone blocks, cinder blocks and Adobe blocks. Generally speaking, such structural building blocks are relatively strong, are relatively inexpensive to make and install, provide excellent thermal mass and offer a high yield rate in production and construction. Accordingly, these attributes make structural building blocks a preferred building material in many construction applications.

In fact, there are two factors that have contributed to the growing use of structural building blocks for constructing walls in buildings and homes. The first factor is that the cost of wood building materials has increased dramatically due to their decreasing availability. Wood building materials such as, for example, wood wall studs have become less available and, accordingly, more expensive. Additionally, in many instances, this decreasing availability has lead to a corresponding decrease in overall quality of such wood building materials. For example, straightness of wood wall studs has decreased as their availability has decreased. The second factor contributing to the growing use of structural building blocks is that structural building blocks generally are capable of providing better protection in severe weather than is wood building materials. For example, in a hurricane, a home having walls constructed from structural building blocks will typically offer a higher degree of protection from high wind speeds than would a wood studs.

Because of the mass and volume of typical structural building blocks, they provide for a relatively large thermal mass attributes. However, one limitation of structural building blocks is that they provide less than desirable and/or suitable insulating attributes. This limited thermal insulation often results in the need to add an insulation layer to the building block structure for applications where the interior space of a building structure is climate controlled (e.g., a house) with the expectation of maintaining a comfortable interior environment. In some cases, forming a double wall provides the insulation layer and the air space between the two walls (i.e., spaced apart walls) of the double wall serves as the insulating layer. In other cases, some form of insulating material is placed in the air space between the two walls of the double wall or on an interior or exterior face of a structural building block wall.

Two shortcoming of the practice of building double walls from structural building blocks are the difficulty in maintaining relatively uniform spacing between the two walls and maintaining structural integrity between the two walls. It is desirable for the space between a double wall to be relatively uniform and of a specified width such that aesthetic and architectural attributes (e.g., visual appearance and architectural dimensions) are maintained to a suitable degree of accuracy. Similarly, it is desirable for multiple layers of a double wall to be suitably interlocked to provide for structural rigidity. Conventional structural building blocks are limited in their ability to create uniform spaces between spaced apart walls and to uniformly connect multiple layers of the double wall. For example, it is common for double walls built from structural building blocks to be joined only at the upper-most layer via a masonry bond beam, which leaves the remainder of the two walls unsupported from lateral movement.

Therefore, a structural building blocks system and associated arrangement configured for building walls in a manner that overcomes drawbacks associated with conventional approaches for building walls using structural building blocks would be useful, advantageous and novel.

SUMMARY OF THE DISCLOSURE

Embodiments of the present invention advantageously overcome one or more shortcomings associated with conventional approaches for building walls using structural building blocks. More specifically, embodiments of structural building blocks in accordance with the present invention include integral means for creating uniform spaces within the walls (i.e., uniformly and consistently spaced apart building blocks) and for uniformly interconnecting multiple layers of the walls. Additionally, structural building blocks in accordance with the present invention offer traditional desirable attributes of structural building blocks such as being relatively strong, being relatively inexpensive to make and install, providing excellent thermal mass, and offering a relatively high yield rate in production and construction.

In one embodiment of the present invention, a building block arrangement is configured for constructing residential, industrial and commercial structures. The building block arrangement comprises alternating layers of a first configuration of building block and a second configuration of building block. A layer of the first configuration of building block includes spaced apart rows of the first configuration of building block such that a space is provided between adjacent side faces of the first configuration of building block of the spaced apart rows. The space includes communicative horizontal and vertical portions such that that the space at least partially isolates an interior wall portion from an exterior wall portion. A layer of the second configuration of building block includes at least one row of the second configuration of building block. The at least one row of the second configuration of building block laterally spans at least a portion of the space provided between the adjacent side faces of the layer of the first configuration of building block.

In another embodiment of the present invention, a system of building blocks is configured for use in constructing residential, industrial and commercial structures. The system of building blocks comprises a plurality of different configurations of building blocks. A first configuration of building block has an interlock structure provided at an upper face thereof and provided at a lower face thereof. A second configuration of building block has at least two adjacent spaced apart interlock structures provided at an upper face thereof and provided at a lower face thereof. A stepped portion is provided in at least one of the upper face and the lower face such that a horizontal space is provided between adjacent layers of said building blocks when stacked. The interlock structure provided at the upper face of the first configuration of building block and the interlock structure provided at the lower face of the first configuration of building block are each configured, respectively, for being interlockably engaged with each one of the interlock structures provided at the lower face of the second configuration of building block and for being interlockably engaged with each one of the interlock structures provided at the upper face of the second configuration of building block.

In another embodiment of the present invention, a method of constructing structures comprises forming a first layer of building blocks such that the first layer includes spaced apart rows of the building blocks. A space is provided between adjacent side faces of the building blocks of the first layer. The space includes communicative horizontal and vertical portions such that that the space at least partially isolates an interior wall portion from an exterior wall portion. The building blocks of the first layer are interlockable with building blocks of adjacent layers of building blocks. During or after forming the first layer, a utility article and/or a barrier material is disposed within at least a portion of the space. After at least a portion of the first layer is formed, a second layer of building blocks is formed on top of the first layer of building blocks. The building blocks of the second layer are interlockably engagable with building blocks of adjacent layers of building blocks. The second layer of building blocks spans at least a portion of the space in the first layer of building blocks. Forming the second layer includes interlocking at least a portion of the building blocks of the first layer with at least a portion of the building blocks of the second layer.

These and other objects, embodiments advantages and/or distinctions of the present invention will become readily apparent upon further review of the following specification, associated drawings and appended claims.

DETAILED DESCRIPTION OF THE DRAWING FIGURES

Figure 1:
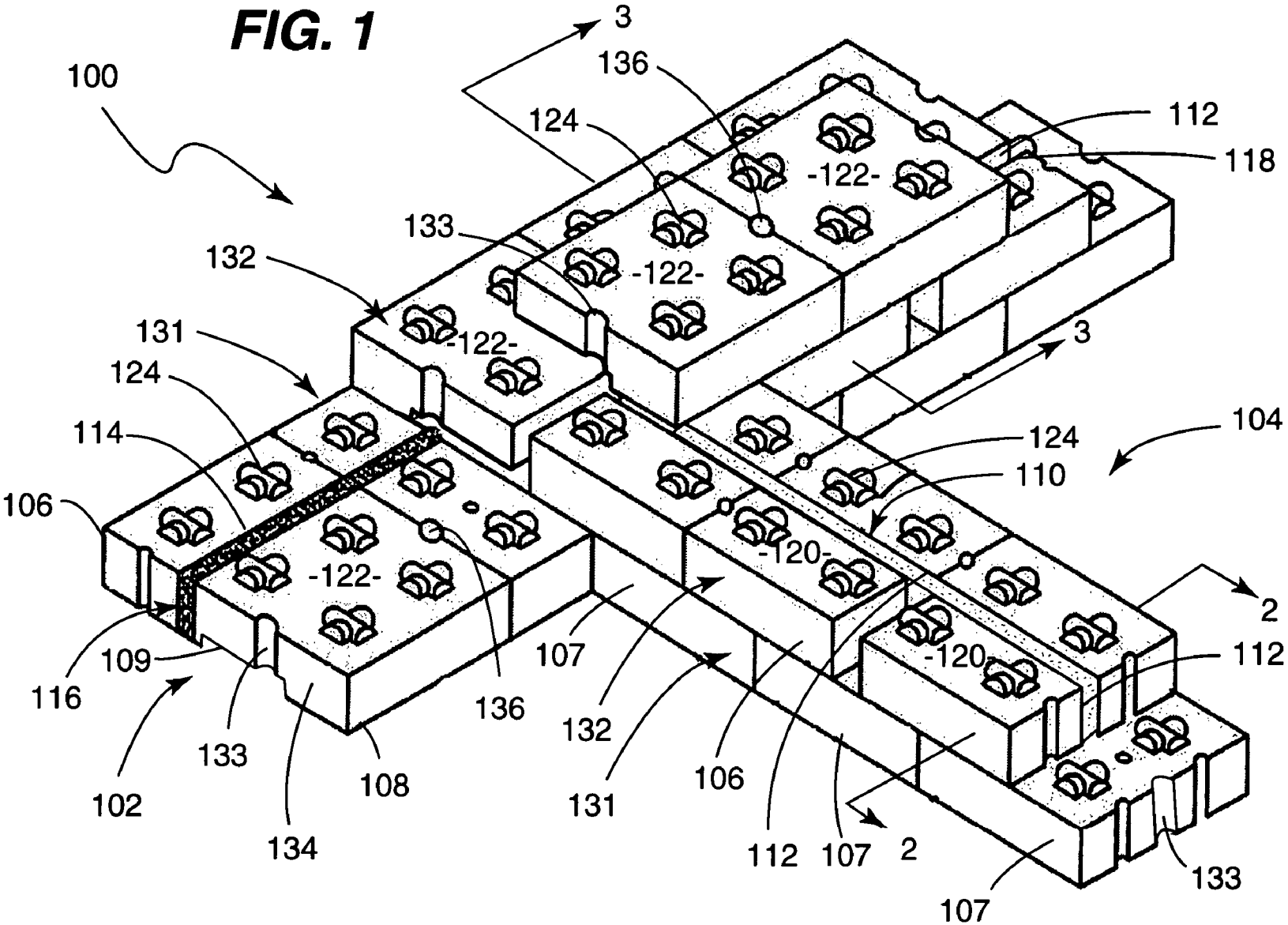
FIG. 1 depicts an embodiment of a building block arrangement configured for constructing residential, industrial and commercial structures in accordance with the present invention.

FIG. 1 depicts an embodiment of a building block arrangement configured for constructing residential, industrial and commercial structures in accordance with the present invention, which is generally referred to herein as the building block arrangement 100. The building block arrangement 100 includes an exterior wall 102 and an interior wall 104. The interior wall 104 includes alternating layers of single-engagement building blocks 106 and non-stepped multiple-engagement building blocks 107. The exterior wall 102 includes layers having spaced apart rows of the single-engagement building blocks 106 and the stepped multiple-engagement building blocks 108. The stepped multiple-engagement building blocks 108 include a stepped portion 109, whose functionality will be discussed in greater detail below.

As will be discussed in greater detail below, it is disclosed herein that the exterior wall 102 and the interior wall 104 may use one or more different configurations of single-engagement building blocks and multiple-engagement building blocks. However, in a broad interpretation the single-engagement building blocks 106 are an embodiment of a first configuration of building block in accordance with the present invention and the multiple-engagement building blocks (107, 108) are an embodiment of a second configuration building block in accordance with the present invention.

Each layer of single-engagement building blocks 106 of the interior wall 104 includes spaced apart rows of single-engagement building blocks 106. In this manner, an interior wall space 110 is provided between adjacent side faces 112 of the single-engagement building blocks 106. Each layer of non-stepped multiple-engagement building blocks 107 of the interior wall 104 includes a single row of multiple-engagement building blocks 106. The non-stepped multiple-engagement building blocks 107 of the interior wall 104 laterally span the interior wall space 110 of the adjacent layers of the interior wall 104. In doing so, structural integrity between the spaced apart rows of the single layer building blocks 106 is enhanced. A barrier material 114 such as, for example, segments of rigid insulation, expanding foam, granulised foam or the like is optionally disposed in the interior wall space 110 for enhancing noise and/or thermal insulating properties of the interior wall 104.

The spaced apart rows of the single-engagement building blocks 106 and the stepped multiple-engagement building blocks 108 in the exterior wall 102 provide an exterior wall space 116 between adjacent side faces 112 of the single-engagement building blocks 106 and side faces 118 of the stepped multiple-engagement building blocks 108. The stepped multiple-engagement building blocks 108 of each layer of the exterior wall 102 laterally span the exterior wall space 116 of the adjacent layers of the exterior wall 102. In doing so, structural integrity between the spaced apart rows of the building blocks of the exterior wall 102 is enhanced. Barrier material 114 (e.g., segments of rigid insulation, expanding foam, granulised foam or the like) is preferably disposed in the exterior wall space 116 for enhancing noise and/or thermal insulating properties of the exterior wall 102. To further enhance noise and/or thermal insulating properties of the exterior wall 102, it is disclosed herein that a layer of barrier material is provided either integrally (provided on an upper face and/or lower face of each non-stepped multiple-engagement building block 108) or discretely between mating faces of each non-stepped multiple-engagement building block 108 (i.e., a sheet of a barrier material).

Figure 2:
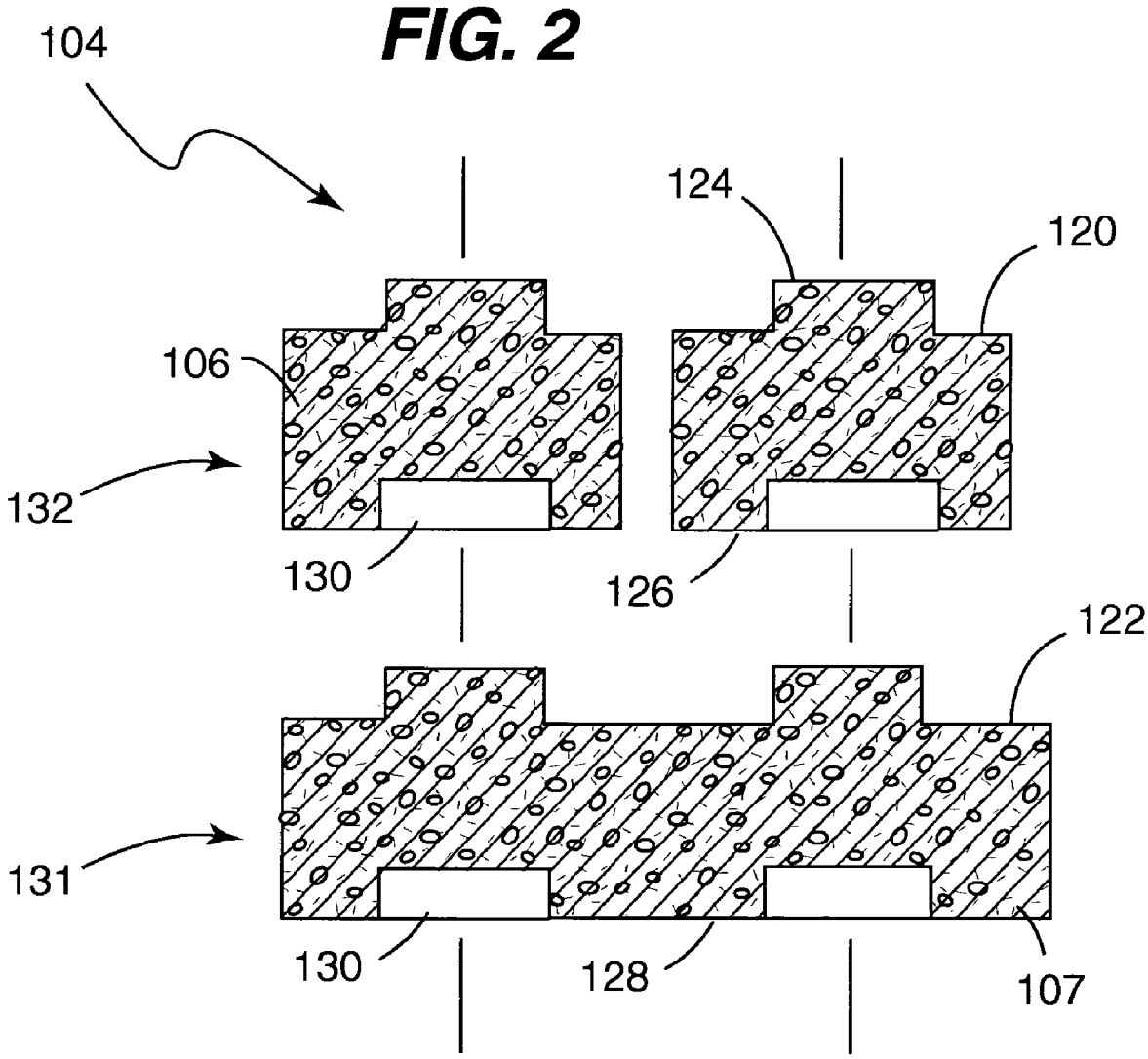
FIG. 2 is an expanded cross sectional view taken along the line 2-2 in FIG. 1.

Referring now to FIGS. 1 and 2, an upper face 120 of each one of the single-engagement building blocks 106 and an upper face 122 of each one of the multiple-engagement building blocks (107, 108) include a first configuration of interlocking structure (i.e., the first configuration interlocking structure 124). A lower face 126 of each one of the single-engagement building blocks 106 and a lower face 128 of each one of the multiple-engagement building blocks (107, 108) include a second configuration of interlocking structure (i.e., the second configuration interlocking structure 130). Thus, at least a portion of the building blocks (106, 107, 108) of one layer of the exterior wall 102 and one layer of the interior wall 104 are interlockably engagable with the building blocks of one or more adjacent layers.

Mating interlocking structures of the single-engagement building blocks 106 and the multiple-engagement building blocks (107, 108) enable such interlocking engagement with the building blocks of one or more adjacent layers. Each face (120, 126) of the single-engagement building blocks 106 include a single set of interlocking structures, thus enabling each single-engagement building block 106 to form a single row of building blocks within a wall (i.e., a single-engagement building block). Each face (122, 128) of the multiple-engagement building blocks 106 include two sets of interlocking structures (i.e., a plurality of interlocking structures), thus enabling each multiple-engagement building block (107, 108) to engage multiple rows of adjacent building blocks within a wall (i.e., a multiple-engagement building block). Through such interlocking engagement, the first configuration interlocking structure 124 and the second configuration interlocking structure 130 jointly locate respective engaged building blocks laterally and longitudinally. Furthermore, the interlocking engagement provided by the interlocking structures (124, 130) serves to maintain a relatively uniform spacing between the two spaced apart rows of building blocks and maintaining structural integrity between such spaced apart rows.

It is disclosed herein that an interlocking structure preferably, but not necessarily, locates building blocks laterally and longitudinally. For example, in other embodiments of the present invention, the interlocking structure comprises an elongated channel that engages a mating interlocking member (e.g., a longitudinal ridge, discrete protruding features, etc) for facilitating constrained lateral locating and at least partially user selectable longitudinal locating.

With respect to the exterior wall 102, a first set of upper face interlocking structures of each stepped multiple-engagement building block 108 of a first layer 131 is engaged with a first set of lower face interlocking structures of a corresponding stepped multiple-engagement building block 108 of a second layer 132. Similarly, the upper face interlocking structures of each single-engagement building block 106 of the first layer 131 is engaged with a second set of lower face interlocking structures of the corresponding stepped multiple-engagement building block 108. In this fashion, adjacent layers of the exterior wall 102 are interlocked, spaced apart building blocks of each layer are uniformly interlocked and spaced apart rows are uniformly spaced apart from each other. With respect to the interior wall 104, a first set and second set of upper face interlocking structures of each stepped multiple-engagement building block 108 of the first layer 131 is engaged with the lower face interlocking structures of corresponding spaced apart single-engagement building blocks 106 of the second layer 132. In this fashion, adjacent layers of the interior wall 104 are interlocked, spaced apart building blocks of each layer are uniformly interlocked and spaced apart rows are uniformly spaced apart from each other.

Still referring to FIGS. 1 and 2, the first configuration interlocking structure 124 consists of a cross-shaped protrusion and the second configuration interlocking structure 130 consists of a cross-shaped recess configured for receiving the cross-shaped protrusion. Thus, rotation of the building blocks (106, 108) is limited to 90-degree increments while still permitting interlocking engagement. It is disclosed herein that other embodiments of the first configuration interlocking structure 124 and the second configuration interlocking structure 130 (e.g., cylindrical-shaped protrusions and recesses), which provide lateral and longitudinal locating functionality, are contemplated. Additionally, it is disclosed herein that still other embodiments of the first configuration interlocking structure 124 and the second configuration interlocking structure 130 may provide for longitudinal locating functionality only (i.e., building block position is longitudinally unrestrained).

It is disclosed herein that interlocking structures in accordance with the present invention may be fully or partially shearable. In such embodiments of the present invention, sufficient lateral movement causes at least a portion of the interlocking structure to shear, thereby allowing lateral and/or longitudinal displacement of adjacent layers of building blocks. The interlocking structures may be configured to be asymmetrically shearable such that they shear to enable the building blocks to displace in a desired direction (i.e., longitudinally more than laterally) of displacement in a desired Such shearing functionality is particularly useful and valuable in environments where soil is prone to shift and where earthquakes are probable.

Figure 3:
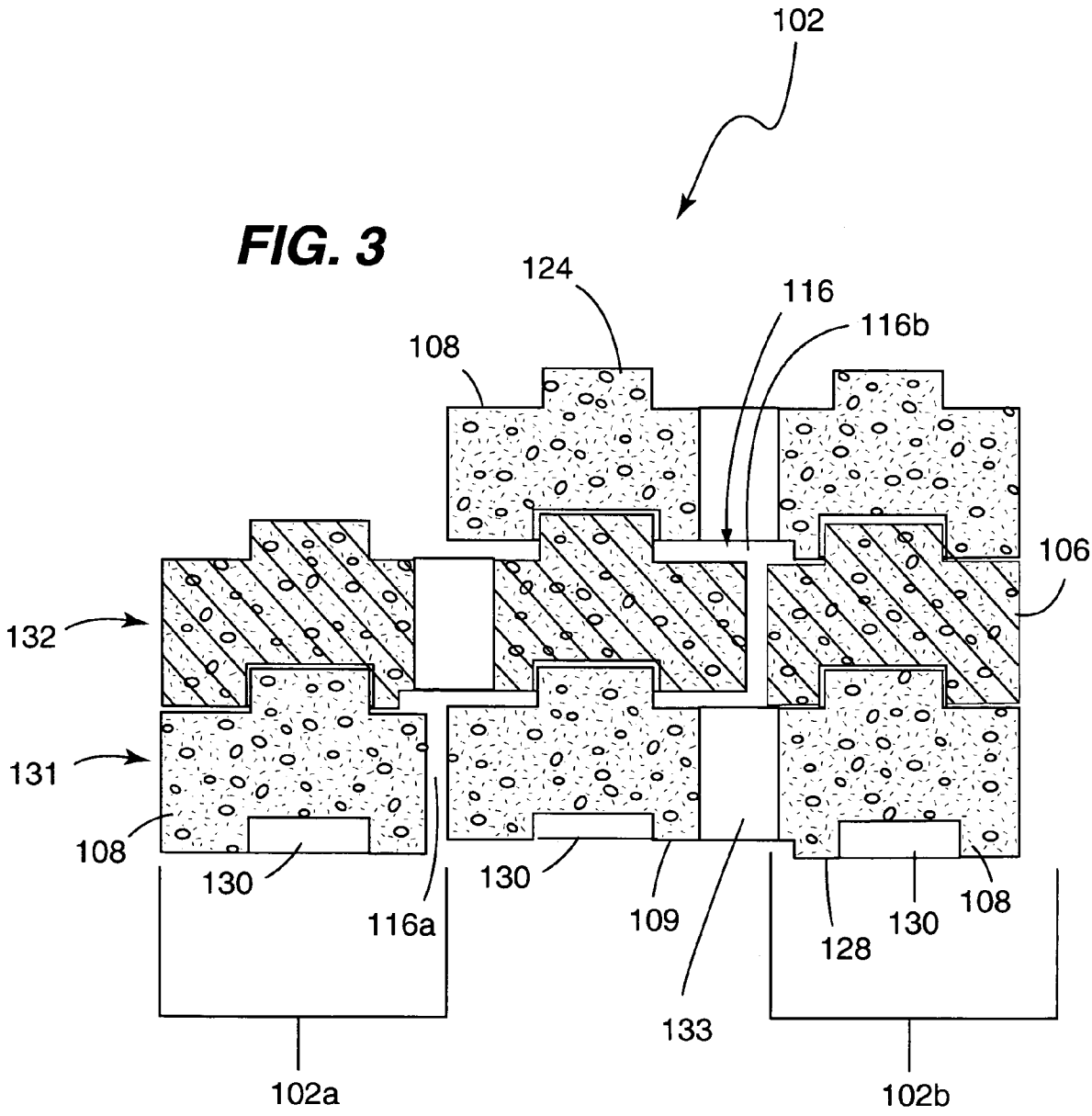
FIG. 3 is a cross sectional view taken along the line 3-3 in FIG. 1.

As best depicted in FIG. 3, the exterior wall space 116 includes a vertical portion 116*a* and a horizontal portion 116*b*. Each stepped multiple-engagement building blocks 108 used in the exterior wall 102 includes a stepped portion 109, which at least partially defines the horizontal portion 116*b* of the exterior wall space 116. The exterior wall space 116 serves to at least partially isolate (e.g., thermally and/or mechanically) an exterior wall portion 102*a* of the exterior wall 102 from an interior wall portion 102*b* of the exterior wall 102. In doing so, the rate of thermal transfer between the exterior wall portion 102*a* of the exterior wall 102 and the interior wall portion 102*b* of the exterior wall 102 is advantageously reduced relative to a wall without such isolation. It is disclosed herein that an insulating material besides air may be deposited within the vertical portion 116a and/or the horizontal portion 116*b* of the exterior wall space 116. Examples of such insulating materials include but are not limited to foam-based insulation, fibreglass-based insulation, insulation-filled grout, insulation-filled mortar and the like.

The exterior wall portion 102*a* includes exterior exposed ones of the single-engagement building blocks 106 and adjacent portions the stepped multiple-engagement building blocks 108 above and below the exterior exposed ones of the single-engagement building blocks 106. The interior wall portion 102*b* includes interior exposed ones of the single-engagement building blocks 106 and adjacent portions the stepped multiple-engagement building blocks 108 above and below the interior exposed ones of the single-engagement building blocks 106.

Referring now to FIGS. 1 and 3, the stepped multiple-engagement building blocks 108 include a utility passage channel 133 in an end face 134 thereof. Each utility passage channel 133 is positioned such that end-to-end engagement of two of the stepped multiple-engagement building blocks 108 forms a vertically extending utility passage 136. The utility passage channel 133 of each one of the stepped multiple-engagement building blocks 108 and the space 110 of the interior wall 104 and the vertical portion 116*a* of the exterior wall space 116 are each positioned such that the vertically extending utility passage 136 formed by two adjacent utility passage channels 133 is positioned at least partially in-line with the corresponding space of the respective wall (102, 104). Accordingly, the vertically-extending utility passage 136 and the space (110, 116) of the respective wall (102, 104) enable one or more utility articles to be routed vertically and horizontally within the respective wall (102, 104). For example, wires, pipes, electrical conduit and the like may be routed through one or more vertically-extending utility passages 136, the interior wall space 110 and the exterior wall space 116.

The first configuration interlocking structure 124 and the second configuration interlocking structure 130 are jointly configured such that engagement of the first configuration interlocking structure 124 and the second configuration interlocking structure 130 serves to structurally maintain the horizontal portion 116*b* within the stepped portion 109. For example, the height of the first configuration interlocking structure 124 and the depth of the second configuration interlocking structure 130 are such that their butted engagement maintains at least a minimum distance between a bottom face of each stepped multiple-engagement building blocks 108 and a top face of an adjacent engaged stepped multiple-engagement building blocks 108. In one optional configuration, various other types of stand-offs may be implement for maintaining at least a minimum distance between a bottom face of each stepped multiple-engagement building blocks 108 and a top face of an adjacent engaged stepped multiple-engagement building block 108 within the stepped portion 109. Examples of such stand-offs include, but are not limited to, raised protrusions (e.g., ridges) that do not provide interlocking functionality. Such raised protrusions may extend in any one of a longitudinal direction, lateral direction and skewed direction with respect to a longitudinal axis of an associated exterior wall. In another optional configuration, the standoffs and/or mating features of the stepped multiple-engagement building block 108 within the stepped portion 109 may be omitted and a discrete standoff item may be inserted between the bottom face of each stepped multiple-engagement building block 108 and a top face of an adjacent engaged stepped multiple-engagement building blocks 108 within the stepped portion 109 of each stepped multiple-engagement building block 108. For example, an application specific insert (e.g., a dowel, disk, cube, etc) that is inserted between two adjacent blocks at the stepped portion may be used to provide standoff functionality. Furthermore, the stepped portion may be formed in the top face of the stepped multiple-engagement building block 108 (i.e., the face depicted as including the protruding interlocking structure) as opposed to the bottom face (i.e., the face depicted as including the recessed interlocking structure). Although the recessed interlocking structure is depicted in FIG. 3 as being in the stepped portion 109, it is disclosed herein that the protruding interlocking structure may be attached to the stepped multiple-engagement building block 108 within the stepped portion 109.

Turning now to a discussion of building block systems, building blocks in accordance with the present invention are elements of a system of building blocks in accordance with the present invention. Such building blocks are configured for enabling walls in accordance with the present invention to be constructed in a manner that is predictable, efficient and consistent. As discussed above in reference to FIGS. 1-3, walls in accordance with the present invention include uniformly and consistently spaced apart building blocks that create a correspondingly uniform and consistent space between the building blocks and that have multiple layers that are uniformly interlocked.

Figure 4:
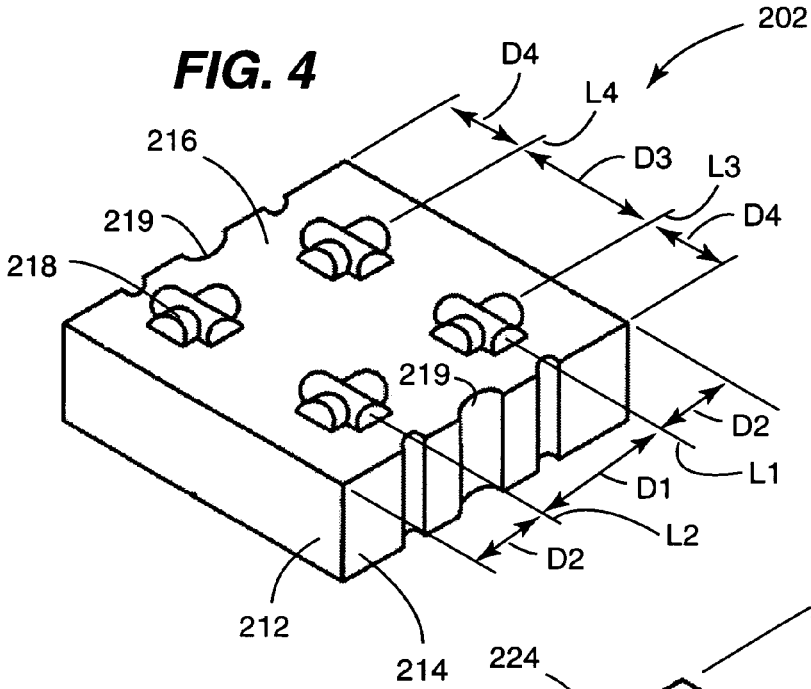
FIG. 4 depicts an embodiment of a laterally and longitudinally symmetric multiple-engagement building block in accordance with the present invention.
Figure 5:
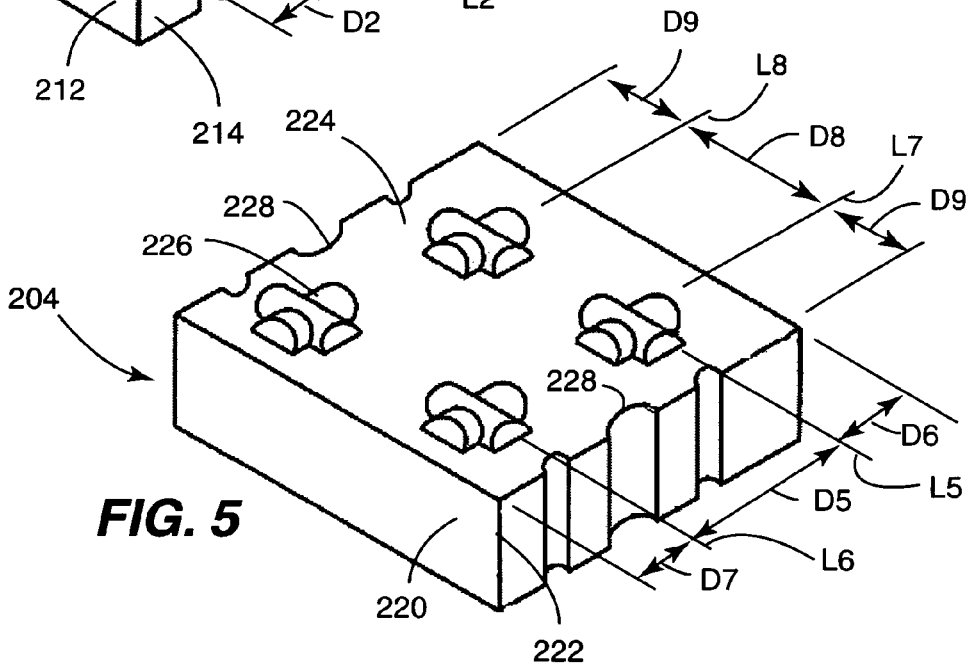
FIG. 5 depicts an embodiment of a laterally asymmetric, longitudinally symmetric multiple-engagement building block in accordance with the present invention.
Figure 6:
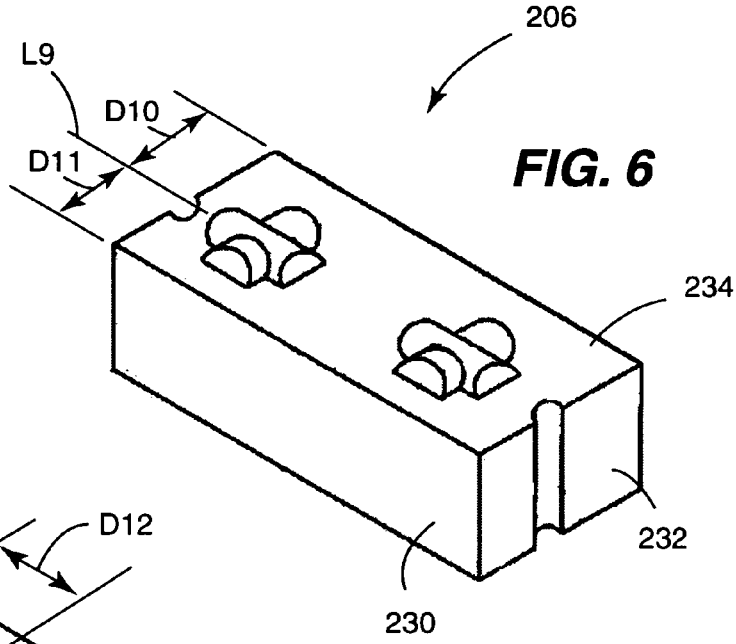
FIG. 6 depicts an embodiment of an offset-side single-engagement building block in accordance with the present invention.
Figure 7:
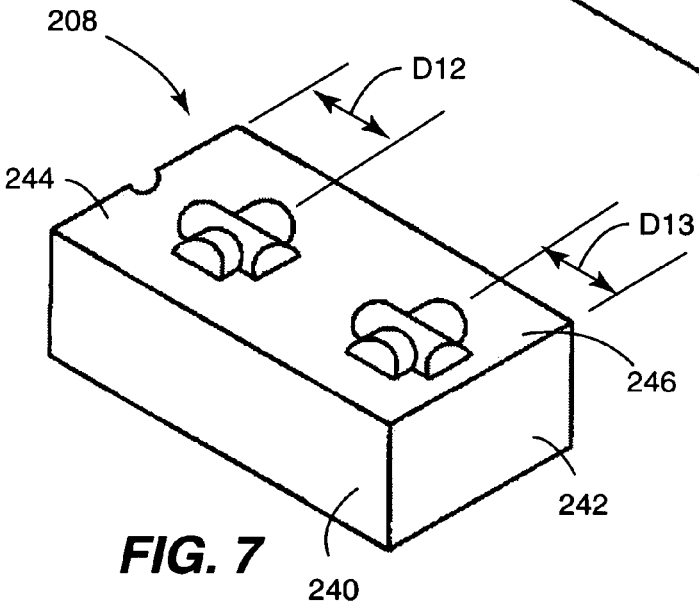
FIG. 7 depicts an embodiment of a laterally and longitudinally asymmetric single-engagement building block in accordance with the present invention.
Figure 8:
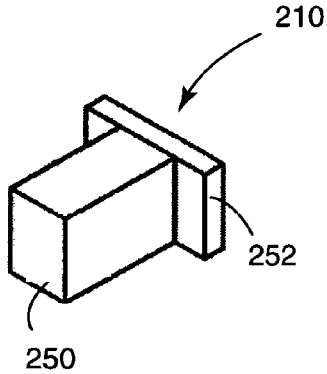
FIG. 8 depicts an embodiment of a nailing plug in accordance with the present invention.

In one embodiment, a system of building blocks in accordance with the present invention includes a standard multiple-engagement building block 202 (FIG. 4), an offset-side multiple-engagement building block 204 (FIG. 5), an offset-side single-engagement building block 206 (FIG. 6), an offset-end single-engagement building block 208 (FIG. 7) and a nailing plug 210 (FIG. 8). Preferably, but not necessarily, the offset-side multiple-engagement building block 204 has a stepped portion as depicted in reference to the stepped multiple-engagement building block 108 depicted in FIGS. 1 and 3. The various building blocks of the system are substantially the same height and are interconnectable such that a broad array of interior and exterior wall arrangements are capable of being constructed. Preferably and advantageously, the various building blocks of the system do not require any alteration for such broad array of wall arrangements to be constructed, which saves time and precludes structural compromises associated with user-configured building blocks. It is disclosed herein that the standard multiple-engagement building block 202 (FIG. 4) and the offset-side multiple-engagement building block 204 (FIG. 5) may each have a stepped configuration (e.g., similar to the stepped multiple-engagement building blocks 108 depicted in FIGS. 1 and 3) or may be non-stepped (i.e., as depicted in FIGS. 4 and 5).

Figure 9:
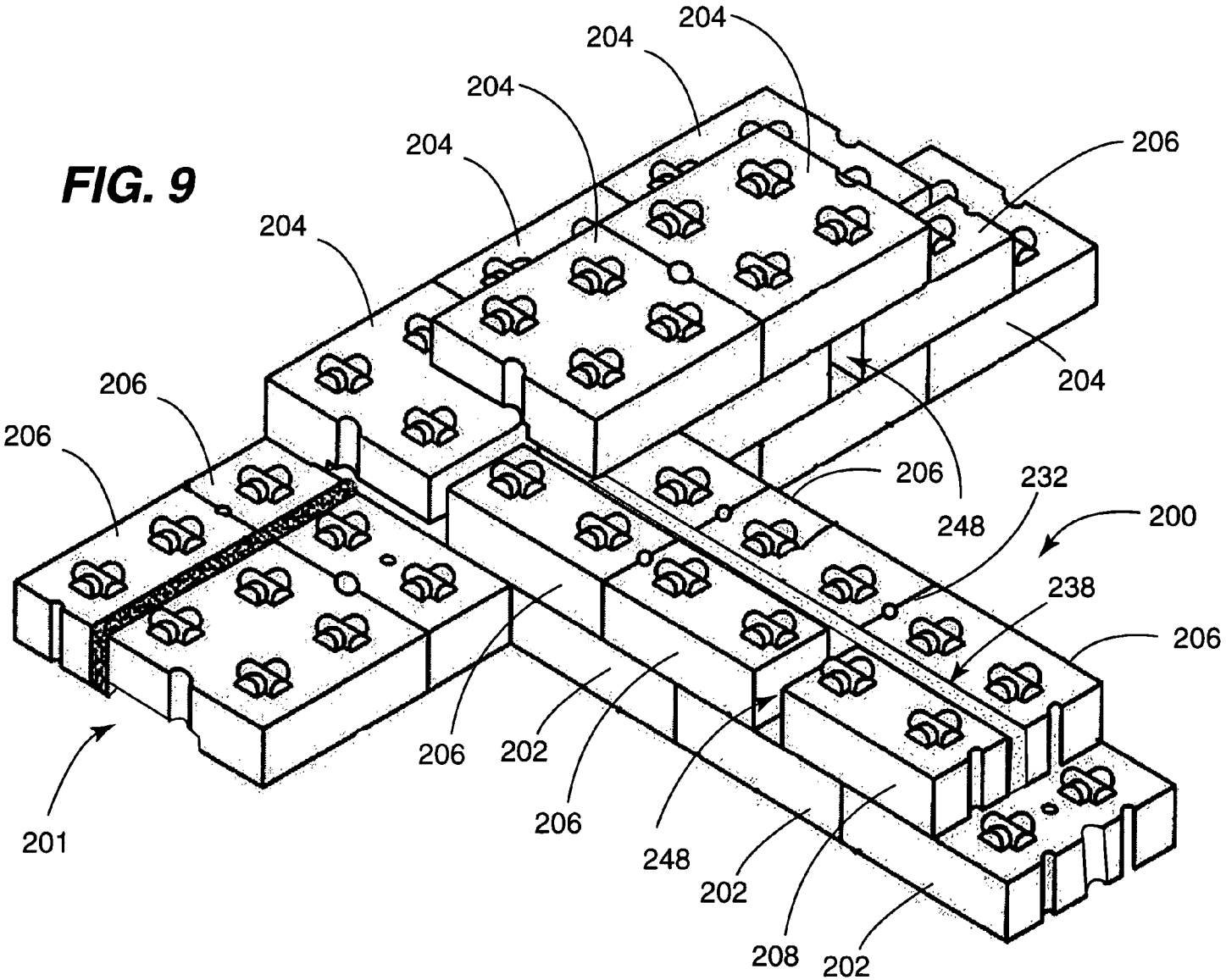
FIG. 9 depicts an embodiment of a wall structure constructed using a system of building blocks in accordance with the present invention.

Typical use of the standard multiple-engagement building block 202 (FIG. 4) includes construction of every other layer of an interior wall 200 depicted in FIG. 9. The standard multiple-engagement building block 202 is non-stepped and includes spaced apart side faces 212, spaced apart end faces 214 and spaced apart support faces 216 (i.e., upper and lower faces). Upper face interlocking structures 218 of the standard multiple-engagement building block 202 are aligned with corresponding lower face interlocking structures (not specifically shown) of the standard multiple-engagement building block 202. A longitudinal centerline L1 of a first set of the interlocking structures 218 is laterally spaced apart from a longitudinal centerline L2 of a second set of the interlocking structures 218 by a distance D1. Each side face 212 is offset from the longitudinal centerline (L1, L2) of the adjacent interlocking structures 218 by a distance D2. A lateral centerline L3 of a first interlocking structure of each set of interlocking structures 218 is longitudinally spaced apart from a lateral centerline L4 of a second set of the interlocking structures 218 by a distance D3. Each end face 214 is offset from the lateral centerline (L3, L4) of the adjacent interlocking structures 218 by a distance D4. Thus, the standard multiple-engagement building block 202 is laterally and longitudinally symmetric. End faces 214 of the standard multiple-engagement building block 202 each include a utility passage channel 219.

Typical use of the offset-side multiple-engagement building block 204 (FIG. 5) includes construction of rows within the each layer of an exterior wall 201 depicted in FIG. 9. The offset-side multiple-engagement building block 202 includes spaced apart side faces 220, spaced apart end faces 222 and spaced apart support faces 224 (i.e., upper and lower faces). The overall length of the offset-side multiple-engagement building block 204 is substantially the same as that of the standard multiple-engagement building block 202. Upper face interlocking structures 226 of the offset-side multiple-engagement building block 204 are aligned with corresponding lower face interlocking structures (not specifically shown) of the offset-side multiple-engagement building block 204.

A longitudinal centerline L5 of a first set of the interlocking structures 218 is laterally spaced apart from a longitudinal centerline L6 of a second set of the interlocking structures 218 by a distance D5. A first one of the side faces 220 is offset from the longitudinal centerline L5 by a first distance D6, which is substantially the same as the distance D2 of the standard multiple-engagement building block 202. A second one of the side faces 220 is offset from the longitudinal centerline L6 by a second distance D7, which is less than the first distance D6. A lateral centerline L7 of a first interlocking structure of each set of interlocking structures 226 is longitudinally spaced apart from a lateral centerline L8 of a second interlocking structure of each set of the interlocking structures 226 by a distance D8, which is substantially the same as the distance D3 of the standard multiple-engagement building block 202. Each end face 222 is offset from the lateral centerline (L7, L8) of the adjacent interlocking structures 226 by a distance D9, which is substantially the same as the distance D4 of the standard multiple-engagement building block 202. Thus, the offset-face multiple-engagement building block 204 is laterally asymmetric and longitudinally symmetric. End faces 222 of the offset-side multiple-engagement building block 204 each include a utility passage channel 228.

Typical uses of the offset-side single-engagement building block 206 (FIG. 6) include construction of alternating layers of the interior wall 200 and construction of rows within each layer of the exterior wall 201 (FIG. 9). The offset-side single-engagement building block 206 includes spaced apart side faces 230, spaced apart end faces 232 and spaced apart support faces 234 (i.e., upper and lower faces). The overall length of the offset-side single-engagement building block 206 is substantially the same as that of the standard multiple-engagement building block 202. Upper face interlocking structures 236 of the offset-side single-engagement building block 206 are aligned with corresponding lower face interlocking structures (not specifically shown) of the offset-side single-engagement building block 206. The longitudinal spacing and relative longitudinal position of the interlocking structures 236 of the offset-side single-engagement building block 206 is substantially the same as that of the standard multiple-engagement building block 202, thereby enabling interconnection therebetween.

A first one of the side faces 230 is offset from a longitudinal centerline L9 of the interlocking structures 236 by a first distance D10. A second one of the side faces 230 is offset from the longitudinal centerline L9 of the interlocking structures 236 by a second distance D11, which is less than the first distance D10. Thus, the offset-side single-engagement building block 206 is laterally asymmetric (i.e., spaced apart side faces that are substantially non-equidistant from a longitudinal centerline of the interlock structures).

Longitudinally, the offset-side single-engagement building block 206 is substantially the same dimensionally as is the standard multiple-engagement building block 202 and the offset-side multiple-engagement building block 204. As depicted in FIG. 9, end faces 232 of two offset-side single-engagement building block 206 effectively abut each other when the two offset-side single-engagement building block 206 are engaged with the same interlocking structure 218 of a face of the standard multiple-engagement building block 202. Additionally, as depicted in FIG. 9, inboard positioning of the second one of the side faces 220 (i.e., offset position side face 220) of the offset-side single-engagement building block 206 provides for creation of an interior wall space 238 and a generally flush exterior surface.

Typical use of the offset-end single-engagement building block 208 (FIG. 7) includes construction of alternating layers of the interior wall 200 and construction of rows within each layer of the exterior wall 201 (FIG. 9). Laterally, the offset-end single-engagement building block 208 is identical to the offset-side single-engagement building block 206 depicted in FIG. 6 (i.e., is laterally asymmetric). The offset-end single-engagement building block 208 includes spaced apart side faces 240, spaced apart end faces 242 and spaced apart support faces 244 (i.e., upper and lower faces). Upper face interlocking structures 246 of the offset-end single-engagement building block 208 are aligned with corresponding lower face interlocking structures (not specifically shown) of the offset-end single-engagement building block 208. The longitudinal spacing and relative longitudinal position of the interlocking structures 246 of the offset-end single-engagement building block 208 is substantially the same as that of the standard multiple-engagement building block 202, thereby enabling interconnection therebetween. A first one of the end faces 242 (i.e., standard position end face) is longitudinally offset from an adjacent interlocking structure 246 by a first distance D12. A second one of the end faces 242 (i.e., offset position end face 242) is longitudinally offset from an adjacent interlocking structure 246 by a second distance D13, which is less than the first distance D12. Thus, the offset-end single-engagement building block 208 is longitudinally asymmetric (i.e., spaced apart end faces that are substantially non-equidistant from adjacent ones of the interlock structures 246) and laterally asymmetric (i.e., spaced apart side faces that are substantially non-equidistant from a longitudinal centerline of the interlock structures)

Use of an offset-end single-engagement building block 208 in the interior wall 200 or the exterior wall 201 results in an exposed gap 248. The nailing plug 210, which is made from a material that a nail or screw can be suitably driven into, is configured for being disposed within the exposed gap 248. For example, the nailing plug 210 includes a first portion 250 sized for fitting within the exposed gap 248 and a second portion 252 sized for fitting in the interior wall space 238. Optionally, the offset-end single-engagement building block 208 is configured such that the exposed gap 248 receives a standard size electrical box.

It is disclosed herein that the system of building blocks may include two versions of the offset-end single-engagement building block 208, which have offset end faces at the opposite end thereof. In this manner, the adjacent use of two such offset-end single-engagement building block 208 results in the exposed gap 248 being twice as wide as when the offset end of the offset-end single-engagement building block 208 is adjacent the standard position end of the offset-side single row building block 206.

As will be appreciated from the inventive disclosures made herein, one aspect of the present invention is creation of a space between spaced apart rows of building blocks. Discussed above are means configured for accomplishing such a space through the use of offset faces of building blocks. It is disclosed herein that such a space can be created through the use of laterally symmetric building blocks. Thus, the present invention is not limited to building blocks with offset side faces. For example, a multiple-engagement building block having a distance between spaced apart interlocking structures (e.g., 13 inches) that is substantially more than twice the width of a mating laterally symmetric single-engagement building block (i.e., 6 inches) would result in a space (e.g., 1-inch wide space) between spaced apart rows of the mating laterally symmetric single-engagement building block interlockably engaged with such an extended-width multiple-engagement building block.

Figure 12:
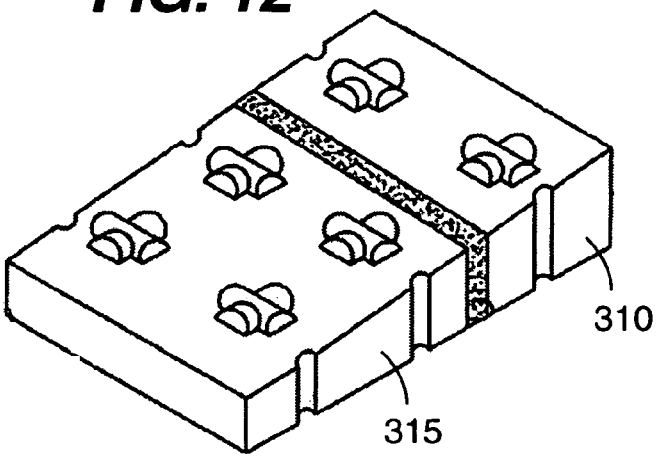
FIGS. 10-12 depict an embodiment of a system of tapered thickness building blocks in accordance with the present invention, which are configured for enabling construction of an arch.
Figure 11:
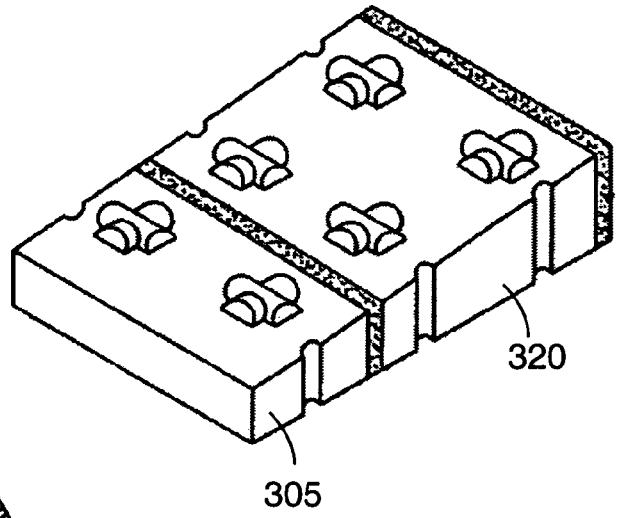
Figure 10:
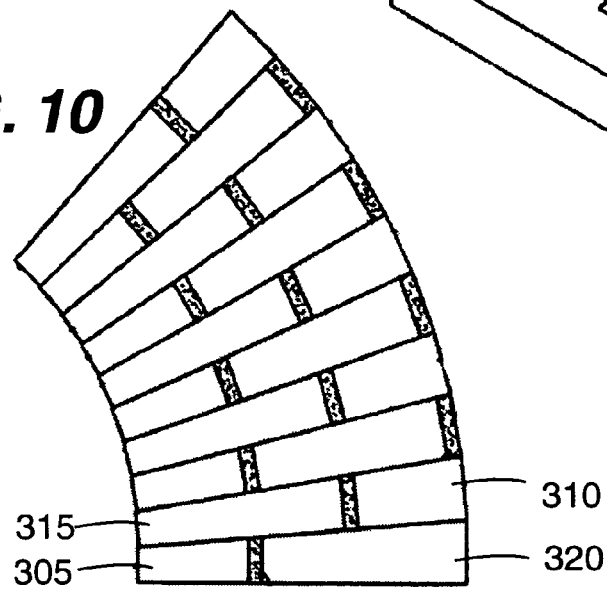

It is disclosed herein that the present invention is not limited to creation of planar walls. The structure of the present invention that enables interlocking functionality and the structure of the present invention that enables creation of interior wall spaces may be applied to non-rectangular blocks. For example, a system of tapered thickness building blocks as depicted in FIGS. 10-12 are configured for producing an arch. The system of tapered thickness building blocks includes an inner single-engagement building block 305, an outer single-engagement building block 310, an inner multiple-engagement building block 315 and an outer multiple-engagement building block 320. The tapered thickness building blocks (305-320) of the system each includes interlocking structure substantially as described above in reference to FIGS. 1-9.

Similarly, a system of tapered thickness building blocks having a wedge-shape profile in the plan view provides for fabrication of domes in accordance with the present invention. However, such blocks for a dome require that each layer of building blocks be configured for providing a smaller diameter circle, as required for creating a generally spherical shape. Another distinction of a system of building blocks configured for fabricating a dome is that interlocking structures of the building blocks preferably locates adjacent blocks radially in a fully constrained manner, but not fully laterally constrained. A ridge and a mating channel on upper and lower faces of such building blocks, respectively, is an example of an interlocking structure useful with such system of building blocks specifically configured for fabricating domes. In this manner, spacing between adjacent building blocks may be adjusted at least a prescribed amount.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A building block arrangement configured for constructing residential, industrial and commercial structures, comprising a first layer of building blocks including a first row of building blocks and a second row of building blocks and wherein said rows are spaced apart whereby a vertically extending space extends between adjacent side faces of at least a portion of said first and second row building blocks; and a second layer of building blocks engaged with a mating face of at least one of said first layer building blocks, wherein said second layer building blocks each span the vertically extending space in the first layer of building blocks, wherein said second layer building blocks each include a passage channel within an end face thereof and extending between upper and lower faces thereof, wherein a channel provided by the passage channel is at least partially aligned with the vertically extending space, wherein said second layer building blocks each include a stepped portion within at least one of said upper and lower faces thereof intersecting the passage channel such that a horizontally extending space extends between said first and second layers of building blocks and intersects the vertically extending space.

2. The building block arrangement of claim 1 wherein:

the first layer of building blocks includes building blocks having an interlocking structure configured for enabling building blocks of the first layer to be interlocked with building blocks of adjacent layers;

the second layer of building blocks includes building blocks having an interlocking structure configured for enabling building blocks of the second layer to be interlocked with building blocks of adjacent layers; and at least a portion of said building blocks of the first layer are interlocked with at least a portion of said building blocks of the second layer.

3. The building block arrangement of claim 2 wherein said building blocks of the first row include space apart side faces that are substantially non-equidistant from a lateral centerline of the interlocking structure.

4. The building block arrangement of claim 3 wherein said building blocks of the first row include spaced apart end faces that are substantially equidistant from a lateral centerline of the interlocking structure.

5. The building block arrangement of claim 2 wherein:

an upper face of each one of said first layer building blocks and each one of said second layer building blocks includes a first configuration of interlocking structure;

a lower face of each one of said layer building blocks and each one of said second layer building blocks includes a second configuration of interlocking structure; and the first configuration of interlocking structure and the second configuration of interlocking structure are interlockably engagable with each other.

6. The building block arrangement of claim 5 wherein the first configuration of interlocking structure and the second configuration of interlocking structure jointly locate respective building blocks laterally and longitudinally with respect to adjacent interlocked building blocks.

7. A system of building blocks configured for use in constructing residential, industrial and commercial structures, the system of building blocks comprising:

a first configuration of building block having an interlock structure provided at an upper face thereof and provided at a lower face thereof; and a second configuration of building block having at least two adjacent spaced apart interlock structures provided at an upper face thereof and provided at a lower face thereof;

wherein the interlock structure provided at the upper face of the first configuration of building block and the interlock structure provided at the lower face of the first configuration of building block are each configured, respectively, for being interlockably engaged with each one of said interlock structures provided at the lower face of the second configuration of building block and for being interlockably engaged with each one of said interlock structures provided at the upper face of the second configuration of building block;

wherein the second configuration of building block includes a stepped portion in at least one of the upper face and the lower face thereof such that a horizontal space is provided between the first configuration of building block and an adjacent building block when stacked in an interlocked fashion; and wherein the second configuration of building block includes a passage channel within at least one end face thereof extending between said upper and lower faces thereof and intersecting the stepped portion.

8. The system of claim 7 wherein the first configuration of building block includes spaced apart side faces that are substantially non-equidistant from a longitudinal centerline of the interlock structure.

9. The system of claim 8 wherein the second configuration of building block includes spaced apart side faces that are substantially non-equidistant from a longitudinal centerline of the interlock structure.

10. The system of claim 8, further comprising:

a third configuration of building block having an interlock structure provided at an upper face thereof and provided at a lower face thereof;

wherein the interlock structure provided at the upper face of the third configuration of building block and the interlock structure provided at the lower face of the third configuration of building block are each configured, respectively, for being interlockably engaged with each one of said interlock structures provided at the lower face of the second configuration of building block and for being interlockably engaged with each one of said interlock structures provided at the upper face of the second configuration of building block; and wherein the third configuration of building block includes spaced apart side faces that are substantially equidistant from a longitudinal centerline of the interlock structure.

11. The system of claim 10, further comprising:

a fourth configuration of building block having an interlock structure provided at an upper face thereof and provided at a lower face thereof;

wherein the interlock structure provided at the upper face of the fourth configuration of building block and the interlock structure provided at the lower face of the fourth configuration of building block are each configured, respectively, for being interlockably engaged with each one of said interlock structures provided at the lower face of the second configuration of building block and for being interlockably engaged with each one of said interlock structures provided at the upper face of the second configuration of building block;

wherein the interlock structure of the forth configuration of building block include a pair of longitudinally spaced apart interlock elements at the upper face thereof; and wherein the fourth configuration of building block includes spaced apart end faces that are each substantially non-equidistant from a lateral centerline of a respective one of said longitudinally spaced apart interlock elements.

12. The system of claim 11, wherein:

the second configuration of building block includes spaced apart end faces;

the second configuration of building block includes a passage channel in each one of said end faces extending between the upper face thereof and lower face thereof; and the passage channels are positioned such that end-to-end engagement of two of the second configuration of building block results in adjacent ones of said passage channels defining a vertically extending passage.

13. The system of claim 12 wherein:

the second configuration of building block includes a layer of barrier material applied to at least one of said faces having said interlock structures provided thereon.

14. The system of claim 7 wherein:

the second configuration of building block includes spaced apart end faces;

the second configuration of building block includes a passage channel in each one of said end faces extending between the upper face thereof and lower face thereof; and the passage channels are positioned such that end-to-end engagement of two of the second configuration of building block results in adjacent ones of said passage channel defining a vertically extending passage.

15. The system of claim 7 wherein:

the second configuration of building block includes a layer of barrier material applied to a least one of said faces having said interlock structures provided thereon.

16. A method of constructing structures, comprising:

forming a first layer of building blocks, wherein the first layer includes spaced apart rows of said building blocks whereby a vertically extending space extends between adjacent side faces of said first layer building blocks and wherein said first layer building blocks are interlockable with building blocks of adjacent layers of building blocks;

disposing at least one of a barrier material and a utility article within at least a portion of the vertically extending space; and forming a first layer of building blocks on top of the first layer of building blocks, wherein said second layer building blocks are interlockably engagable with building blocks of adjacent layers of building blocks, wherein at least a portion of said second layer building blocks span the vertically extending space in the first layer of building blocks, wherein said forming includes interlocking at least a portion of said first layer building blocks with at least a portion of said second layer building blocks, wherein at least one of said second layer building blocks includes a passage channel within an end face thereof and extending between upper and lower faces thereof, wherein a channel provided by the passage channel is at least partially aligned with the vertically extending space, wherein said at least one of said second layer building blocks includes a stepped portion within said lower face thereof intersecting the passage channel such that a horizontally extending space extends between the first and second layers of building blocks and intersects the vertically extending space.

17. The method of claim 16 wherein:

an upper face of each one of said building blocks of the first layer and each one of said building blocks of the second layer includes a first configuration of the interlocking structure;

a lower face of each one of said building blocks of the first layer and each one of said building blocks of the second layer includes a second configuration of said interlocking structure;

the first configuration of interlocking structure and the second configuration of interlocking structure are interlockably engagable with each other; and said forming includes engaging the first configuration of the interlocking structure of at least a portion of said building blocks of the first layer with the second configuration of the interlocking structure of at least a portion of said building blocks of the second layer.

18. The method of claim 16 wherein:

the first layer of building blocks and the second layer of building blocks each includes a row of single-engagement building blocks and a row of multiple-engagement building blocks;

said multiple-engagement building blocks include adjacent spaced apart sets of interlocking structures;

said single-engagement building blocks include a set of interlocking structures;

forming the second row includes engaging a first set of said spaced apart sets of interlocking structures of the multiple-engagement building blocks of the first row with a first set of said interlocking structures of the multiple-engagement building blocks of the first row and engaging a second set of said spaced apart sets of interlocking structures of the multiple-engagement building blocks of the first row with said interlocking structure of the single-engagement building blocks of the first row.

19. The method of claim 18 wherein:

an upper face of each one of said building blocks of the first layer and each one of said building blocks of the second layer includes a first configuration of the interlocking structure;

a lower face of each one of said building blocks of the first layer and each one of said building blocks of the second layer includes a second configuration of said interlocking structure;

the first configuration of interlocking structure and the second configuration of interlocking structure are interlockably engagable with each other; and said forming includes engaging the first configuration of the interlocking Structure of at least a portion of said building blocks of the first layer with the second configuration of the interlocking structure of at least a portion of said building blocks of the second layer.

* * * * *